United States Patent [19]

Vinas

[11] 3,972,207

[45] Aug. 3, 1976

[54] SELECTION DEVICE FOR THE NEEDLES OF A KNITTING MACHINE

[75] Inventor: Juan Vinas, Brooklyn, N.Y.

[73] Assignee: Vinatex Knitting Systems, Inc., Brooklyn, N.Y.

[22] Filed: Nov. 4, 1974

[21] Appl. No.: 520,417

[52] U.S. Cl. ..... 66/50 R; 66/155

[51] Int. Cl.[2] ..... D04B 9/00

[58] Field of Search ..... 66/50 R, 154 A, 155

[56] References Cited

UNITED STATES PATENTS

| | | | |
|---|---|---|---|
| 3,229,482 | 1/1966 | Farmer | 66/50 R |
| 3,232,079 | 2/1966 | Levine et al. | 66/154 A |
| 3,530,686 | 9/1970 | Martinetz | 66/50 R |
| 3,550,398 | 12/1970 | Widdowson | 66/50 R |
| 3,670,527 | 6/1972 | Bourgeois | 66/50 R |
| 3,817,059 | 6/1974 | Krause | 66/154 A |
| 3,855,819 | 12/1974 | Sawazaki | 66/50 R |
| 3,864,942 | 2/1975 | Savage et al. | 66/50 R |

FOREIGN PATENTS OR APPLICATIONS

| | | | |
|---|---|---|---|
| 1,592,748 | 5/1970 | France | 66/154 A |
| 1,214,691 | 12/1970 | United Kingdom | 66/50 R |

*Primary Examiner*—Mervin Stein
*Assistant Examiner*—A. M. Falik
*Attorney, Agent, or Firm*—Friedman & Goodman

[57] ABSTRACT

A selection device for knitting machines having a rotating cylinder with slots around its circumference for accomodating a knitting needle and an associated knitting jack in each slot, the device including a selection tape loop for controlling the jack selectors of the knitting machine. The jack selectors are movable between an operative jack position and a non-operative jack position. Stationary detecting elements co-act with the tape loop for determining the positions of the jack selectors to provide a predetermined knitting pattern. A drive mechanism moves the tape loop in synchronization with the cylinder and relative to the stationary detecting element. Cam elements are provided for moving each of the needle jacks in the operative jack position along its slot into engagement with its associated knitting needle to move the associated knitting needle into an active position for knitting the desired pattern, whereby the needles associated with each of the needle jacks in the non-operative jack position remain in their respective slots and are nonoperative during knitting. Control holes are also provided in the tape loop for coacting with a disengagement mechanism for stopping the drive mechanism at a predetermined time.

6 Claims, 15 Drawing Figures

SELECTION DEVICE FOR THE NEEDLES OF A KNITTING MACHINE

BACKGROUND OF THE INVENTION

The present invention relates to a selection device, and more particularly to a selection device comprising a selection tape for controlling the selectors of a knitting machine which determines the position of the jacks mounted in the cylinder of the knitting machine for co-acting with selected needles required for the knitting process to provide a predetermined knitting pattern.

Though the selection device of the present invention may be used with any type of knitting machine, the present selection device was specifically invented for a circular knitting machine such as, Model KIM from Masriera S.A., Malgrat De Mar (Barcelona), Spain, a description of which was printed in KNITTING TIMES — May 27, 1974. The KIM Machine, which was a rotating dial and cylinder and stationery cambox and yarn stand, is presently in 10 and 12 inch diameters with four feeds, preferably having 280 needles. A pattern drum for controlling the needle selection is disposed at each feed on the machine. The pattern drum contains 24 slots around its circumference. The drum can either take 24 clavettes in each of the slots or individually placed pegs, also 24 high. The clavettes or pegs co-act with 24 selectors at each feed, which in turn select the jacks mounted in the cylinder of the knitting machine which position associated needles required for the knitting process to provide a predetermined knitting pattern.

However, the predetermined knitting pattern of the KIM Knitting Machine is limited in size, both in length and width. Since the pattern drum contains 24 steps, the pattern area is either 24 or 49 wales wide depending on whether the 24 step needle jacks working in conjunction with the drum are set out in a diagonal or V-formation. The depth of the design is 96 courses with the 24 slot drum. Therefore, if a larger predetermined knitting pattern is desired, the pattern drum must be made larger to contain more slots around its circumference, and its vertical length must be increased to provide a greater number of steps for each slot, whereby increasing the size if the pattern drum requires that the size of the knitting machine itself be greatly increased to accomodate same.

Many attempts have been made to increase the predetermined knitting pattern without substantially increasing the size of the knitting machine so that each of the needle jacks can be individually activated by a computer. However, these computerized knitting machines are very expensive and complicated, where the predetermined knitting pattern requires many manhours for its determination, and mistakes therein cannot easily be located and/or corrected.

SUMMARY OF THE INVENTION

This invention relates to a selection device for knitting machines having a rotating cylinder with slots around its circumference for accomodating a knitting needle and an associated needle jack in each slot, the device comprising selection tape means for controlling at least one jack selector, where the jack selector is disposed adjacent to the cylinder. The jack selector is movable between the first position away from the cylinder for preventing engagement with the needle jacks to define an operative jack position, and a second position close to the cylinder for engagement with associated needle jacks to move each of the associated needle jacks into its slot to define a non-operative jack position. The selection tape means include a loop and stationary detecting means coacting with the tape loop for determining the first and second positions of the jack selector to provide a predetermined knitting pattern. Drive means are provided for moving the tape loop in synchronization with the cylinder and relative to the stationary detecting means. Cam means are provided for moving each of the needle jacks in the operative jack position along its slot into engagement with its associated knitting needle to move the associated knitting needle into an active position for knitting the desired knitting pattern, whereby the needles associated with each of the needle jacks in the non-operative jack position remains in their respective slots and are not active during the knitting. Additionally, the selection tape means also includes control means for stopping the drive means at a predetermined time. Preferably, the detecting means include at least one photo electric cell which is activated by a light source which passes through openings in the tape loop.

Accordingly, an object of the present invention is to provide a selection device for knitting machines which overcomes the disadvantages of the prior art.

Another object of this invention is to provide a selection device comprising tape means for controlling the jack selectors of the knitting machine to provide a predetermined knitting pattern.

A further object of this invention is to provide a selection device comprising stationary detecting means coacting with a tape loop for determining a predetermined knitting pattern.

A still further object of the present invention is to provide drive for moving a tape loop in synchronization with the cylinder of a knitting machine, where the tape loop controls the jack selectors of the knitting machine to provide a predetermined knitting pattern.

Yet another object of this invention is to provide control means for disengagement and stopping the drive means of a tape loop, the tape loop controlling the jack selectors which provide a predetermined knitting pattern in the knitting machine.

An added object of this invention is to provide detecting means including at least one photo electric cell for coacting with a tape loop provided with openings therein through which a light source may pass for determining a knitting pattern.

And yet another added object of this invention is to provide a selection device for knitting machines that is simple and inexpensive to manufacture, one which has few parts and can easily be operated.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment, in which.

DESCRIPTION OF THE PREFERRED EMBODIMENT

Figure 1:
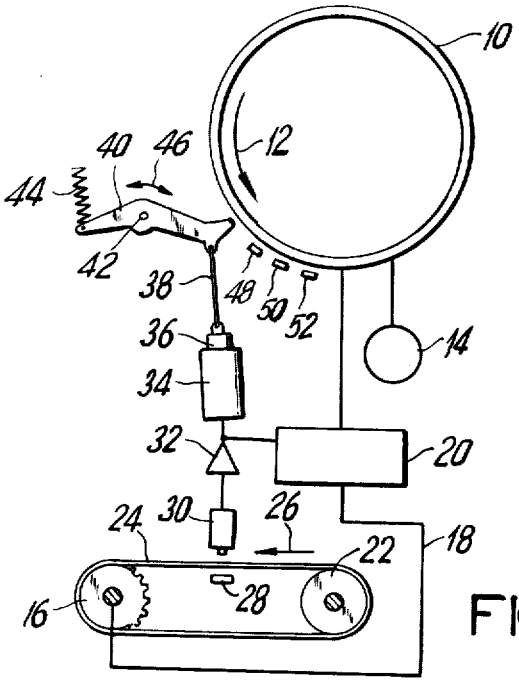
FIG. 1 is a schematic representation of a selection device for the needles of a knitting machine pursuant to the present invention.

Referring to the drawings, FIG. 1 illustrates a schematic representation of a selectional device for the needles of a knitting machine according to the present invention. A conventional cylinder 10 such as used in the above-mentioned KIM knitting machine is rotated in a counter clockwise direction as indicated by arrow 12, about its vertically disposed axis, by means of a conventional motor 14. The cylinder 10 is provided with vertically extending slots or grooves around its circumference for accomodating a needle jack and an associated needle in each slot, there preferably being 280 slots, jacks and needles as will be more fully discussed hereinafter below. Additionally, the cylinder 10 turns or rotates the driver wheel 16 of the tape mechanism which is synchronized therewith by conventional drive means 18. A conventional electro-magnetic clutch 20 is associated with the drive means 18 to disconnect or stop the driver wheel 16, relative to the cylinder 10, as will be set forth hereinafter below in more details.

The tape mechanism includes the driver wheel 16 and a spaced apart idler or free roller 22 for receiving a selection tape 24 thereon in the form of a loop. The space between the driver wheel 16 and the roller 22 is determined by the size of the tape loop 24 which may be made in any desired length. Preferably, the driver wheel 16 moves the tape in a counter clockwise direction as indicated by the arrow 26. A set of conventional light sources 28 is disclosed between the wheels 16, 22 and below the top portion of the tape loop 24 for association with a set of conventional photo electric cells 30 disposed above the top portion of the tape loop 24. Openings or holes in the tape loop 24 allow the light source 28 to activate the photo electric cells 30 in a manner to be set forth in more detail hereinafter below.

A series of amplifiers 32 are connected to the photo electric cells 30 to increase the signal thereof, wherein at least one amplifier is connected to an associated photo electric cell. In turn, an amplifier 32 is electrically connected to a conventional electro magnet or solenoid 34 respectfully, for operating the core or piston 36 therein. However, at least one of the amplifiers and associated photo electric cells 30 are connected directly to the electro magnetic clutch 20 to disengage the drive wheel 16 from the cylinder 10 at a predetermined time, as will be described hereinafter below.

A stiff rod 38 is provided for each core 36 to connect the core 36 to an associated selector 40, there being one selector 40 for each solenoid 34. The selectors 40 are disposed one above the other for pivoting or rotation about the pin 42 passing through each of the selectors 40, thereby defining a vertical stack. A spring 44 is provided for each selector 40 to pull one end thereof to urge or bias the opposite end of the selector 40 away from the outer surface of the cylinder 10. Each rod 38 forces its associated selector 40 towards the cylinder 10 when its respective solenoid 34 is activated, as will be set forth hereinafter below in more detail. Accordingly, each selector 40 is rocked back and forth selectively about the pin 42, as indicated by the directors of the arrows 46, by the pull and push action of the spring 44 and rod 38, respectively.

Additionally, as shown in FIG. 1, a set of cams 48, 50 and 52 are disposed in fixed positions adjacent to the rotating cylinder 10. Cam 48 functions to raise or lift up the jacks in a conventional manner. Cam 50 functions to lower or push down the raised jacks and needles. Cam 52 functions to push the jacks to an "out" position within the slots of the cylinder 10. However, it should be noted that these cams are conventional in knitting machines of this type and are well-known to those skilled in the art. Each of these cams 48, 50 and 52 will be discussed in more detail hereinafter below.

Figure 2:
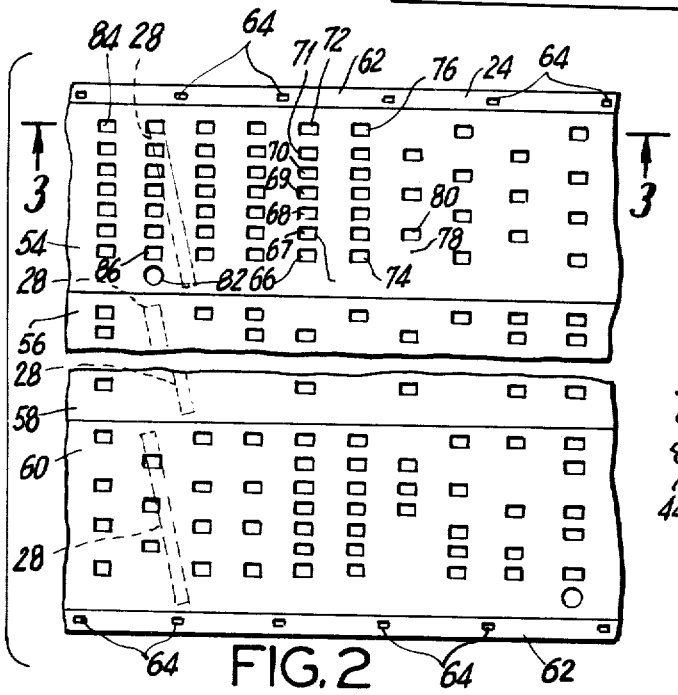
FIG. 2 represents a fragmented top plan view of the selection tape of the present invention.
Figure 3:
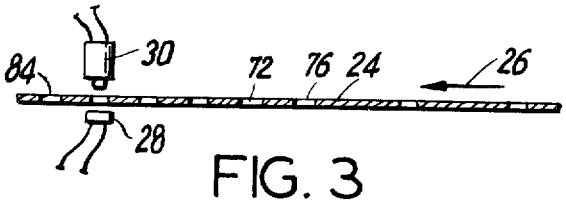
FIG. 3 represents a selectional view, taken on the line 3—3 of FIG. 2.

FIGS. 2 and 3 show the details of the selection tape loop 24 of the present invention. The tape loop 24 is divided into four equal sections 54, 56, 58 and 60, each extending longitudinally around the closed loop. Each section controls one feed station, so that the predetermined width of the tape loop 24 depends upon the number of feed stations in the particular knitting machine. Accordingly, a knitting machine having two feed stations would have only two sections on the tape loop, where a knitting machine having four feed stations, as in the present preferred embodiment, would have four sections as indicated, though only one feed station is shown in FIG. 1 for purposes of illustration only. Both marginal edges 62 of the tape loop 24 are provided with longitudinally spaced apart sprocket holes 64 to enable the sprockets of the driver wheel 16 to engage therein and rotate the tape loop 24 in the direction of arrow 26, as mentioned above.

Each section is divided into eight lines extending longitudinally around the tape loop 24. The first seven lines of each section are for controlling the selectors 40 associated therewith, there being one selector for each line. The eighth line is reserved for controlling the clutch 20. Accordingly, there are seven selectors 40 for each feed station or section of the tape loop 24 providing a total of twenty-eight selectors 40 for this particular type knitting machine.

Additionally, the tape loop 24 is divided into transversally extending rows across the width thereof. The intersection of a row with a line defines a point associated with a particular needle jack and its needle. These points are either punched to provide openings or holes through the tape, or are left alone to provide an opaque surface there at. By way of example, section 54 will be discussed below, but it is understood that this discussion will also apply to the other remaining sections 56, 58 and 60.

As shown in FIG. 2, all the points in an example row of section 54 are punched to provide openings 66 through 72 therein. Each of these openings 66–72 is associated with a particular needle jack mounted in the cylinder 10, where these needle jacks are mounted in consecutive order so that the needle jack associated with opening 66 is adjacent to and disposed right before the needle jack associated with opening 67, relative to the direction of rotation of the cylinder 10 with respect to the feed station associated with section 54. Accordingly, this relationship between the openings and needle jacks is continued so that the opening 71 is associated with a needle jack disposed in front of the needle jack associated with the opening 72, where the latter needle is disposed directly in front of the needle jack associated with opening 74 of the next preceeding row, and so on for the remaining points on the tape loop 24. However, it should be noted that not all the needle jacks are associated with openings. Therefore, the needle jack associated with opening 76 is disposed directly in front of the needle jack associated with an unpunched point 78, with the needle jack associated with opening 80 being right after the needle jack associated with the unpunched point 78. The function of these punched and unpunched points will be discussed hereinafter below.

Figure 4:
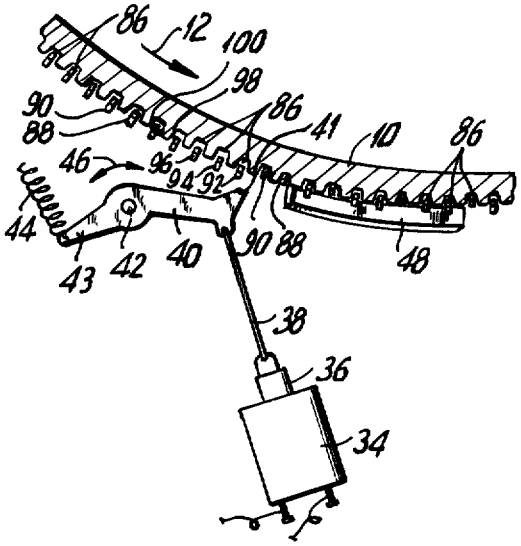
FIG. 4 represents a fragmented top plan view with parts in section, showing a selector mounted relative to the cylinder of the knitting machine.

As shown in FIGS. 2 and 4, a separate coventional light source 28 is disposed below each section, extending across from the first line to the eighth line thereof. Each light source 28 and the set of photo electric cells associated therewith are disposed diagonally or at an angle to the transverse direction of the rows, with the longitudinal spacing or displacement from one end of the light source to the opposite end of the light source being approximately equal to the spacing between adjacent rows. Thus, at one time a number of the openings of the rows are at different stages, such as beginning to pass over, are directly over, or are ending the pass over the light source 28. Accordingly, the opening 66 will pass above the light source 28 before the opening 67, and the opening 72 will pass above the light source 28 before the opening 74, and so on, with the tape loop 24 moving in the direction of arrow 26.

For example, openings 66, 67 and 68 can be affecting a signal, opening 69 can be starting to be affected by the light source 28, and the remaining openings 70, 71 and 72 can be unaffected by the light source 28 at a particular time during the operation. It is further noted, that the opening 66 is still affected by the light source 28 by the time the opening 74 is starting to move over the light source 28. Thus, the photo electric cell 30 which is associated with the line containing these two openings 66 and 74, is continuously activated from the time opening 66 first begins to pass over the light source 28 to the time that the opening 74 completely passes over the light source 28.

A control hole 82 is disposed in the eighth line, where this hole may be disposed anywhere along the eighth line for activating the clutch 20, it being noted that more than one control hole may be disposed in this eighth line as desired to achieve a particular knitting pattern. It is also noted, that the clutch 20 will be activated after the needle jack associated with opening 84 is effected by the signal provided by the opening 84, but before the signal provided by opening 86.

A set of eight conventional photo electric cells 30 is provided for each light source 28 of each section, being diagonally disposed in vertical alignment therewith directly above the tape loop 24. One photo electric cell 30 is provided for each line, the set being disposed diagonally across the width of the tape. Additionally, each photo electric cell is connected to an associate conventional amplifier 32 to increase the signal of the photo electric cell. Accordingly, seven of the amplifiers, which are associated with each section of the tape, are each connected to an associated conventional solenoid 34, with the eighth amplifier being connected to the clutch 20.

The tape loop 24 is opaque, being preferably formed from a plastic material, though the tape loop may also be formed from metal such as steel, photographic film, or the like. Accordingly, the punched out holes in the tape loop permit the light from the source 28 to shine or pass therethrough and activate the photo cells disposed there above, where the light from the source 28 will not pass through the opaque or unpunched portions of the tape. The light from the source 28 may be conventional white light, infra-red, or the like.

In a modified form of the present invention, direct electrical contacts such as micro-switches, can be used in place of the photo electric cells and the light sources, so that contact is made through the openings or holes in the tape loop directly to electrical contacts mounted under the tape in such a manner to function as the light source. Alternatively, wheels synchronized with the tape loop can be provided with spring pins for making contact through the openings in the tape loop with electrical contacts similar to those mentioned above. It is still further noted, that commercially available magnetic means may be used to pick up signals which are disposed on the tape, similar to the manner well known in the tape recorder art.

Thus, the openings in the tape loop 24 provide the knitting pattern, where these openings determine which needles in the cylinder 10 are selected at each feed station. Accordingly, as will be shown below, the selection of these needles will provide the knitting design, such as a jacquard pattern, that is limited only by the width of the fabric, and is unlimited in its length.

FIG. 4 illustrates one of the feed stations of the knitting machine. The enlarged sectional view of the cylinder 10 shows a series of grooves or slots 86 provided in the outer surface of the cylinder 10. The slots 86 are spaced apart and vertically disposed completely around the circumference of the cylinder 10. The slots 86 accommodate and hold the needle jacks and associated needles therein, so that there is a jack and needle for each slot.

A stack of seven selectors 40 is disposed for rotation on the pin 42 which passes through each selector 40. The stack of selectors is located adjacent to the cylinder 10 so that one end 41 of each selector can be rotated into an abutting contact with an associated knitting jack, as will be set forth below. A spring 44, provided for each selector 40, tensions or pulls on the other end 43 of each selector so that the abutting end 41 is normally disposed away from and out of contact with the knitting jacks, as shown.

Each selector 40 is provided with a solenoid 34, which solenoid 34 is activated by the increased signal from its associated amplifier 32 as mentioned above. The core 36 of each solenoid 34 is connected by a stiff rod 38 to the end portion 41 of its associated selector 40.

Accordingly, when the light from light source 28 passes through an opening in the tape loop 24 and activates the photo cell 30, an associated amplifier increases the signal from the activated photo cell 30 and thereby activates its associated solenoid 34, thereby moving the core 36 out of the solenoid 34 in a conventional manner in a direction towards the selector 40. The core 36 moves the rod 38 in the same direction, thereby forcing the end 41 of the selector towards the cylinder 10 and into engagement with an associated needle jack.

When the light from the source 28 no longer activates the photo cell 30, as when an unpunched portion of the tape loop 24 passes therebetween, the solenoid 34 is deactivated and the spring 44 pulls on the end 43 so that the other end 41 of the selector 40 is moved away from the cylinder 10 to its normal position. It should be noted, that the force exerted by the activated solenoid 34 is greater than the tension of the spring 44, to permit the back and forth motion of the selector 40 about the pin 42 in the direction of the arrows 46.

Figure 5:
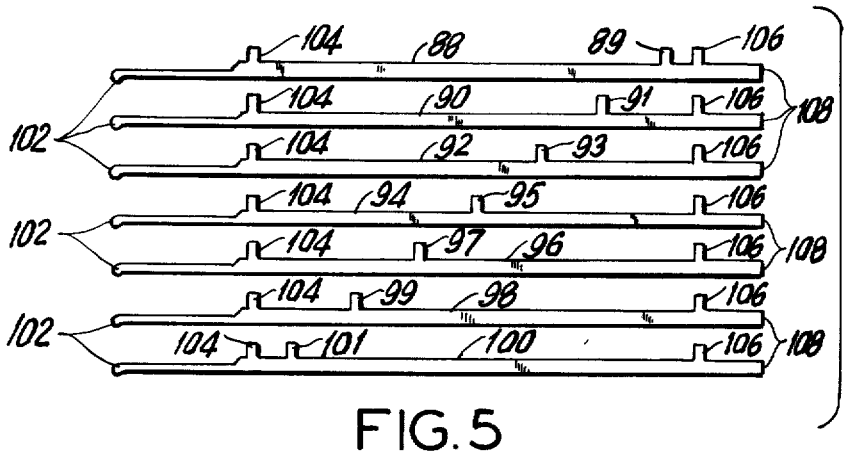
FIG. 5 represents a set of needle jacks of the present invention.
Figure 6:
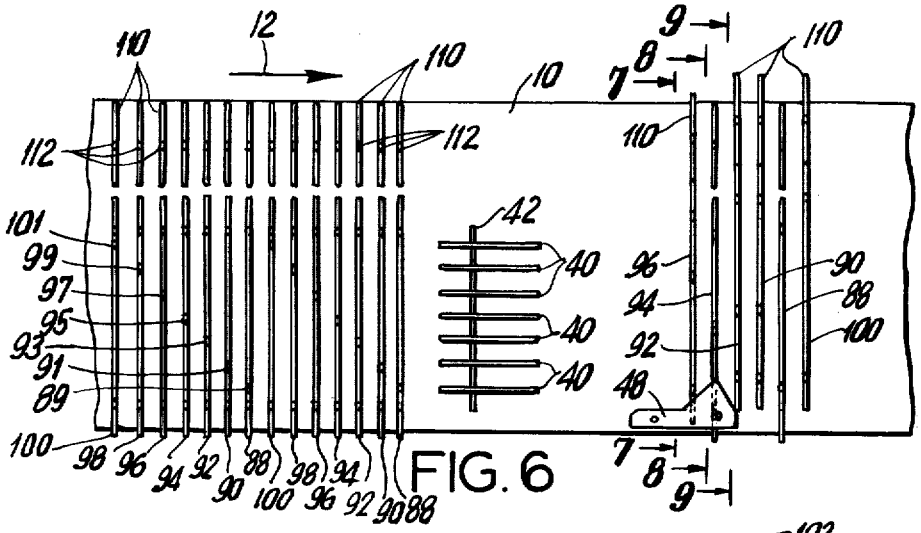
FIG. 6 represents a schematic fragmented illustration of the arrangement of the selectors relative to the needle jacks and associated needles mounted in the cylinder of the knitting machine.

The needle jacks are arranged in sets, there being seven different needle jacks in each set. FIG. 5 shows a set of seven needle jacks 88, 90, 92, 94, 96, 98 and 100, with needle jack 88 being the first jack and needle jack 100 being the last jack of each set. As shown in FIGS. 4 and 6, needle jack 88 consecutively follows needle jack 100 of the previous set, and so on completely around the circumference of the cylinder 10.

Each needle jack has a pivot end portion 102 and a cam engaging tab 104 adjacent to the end 102. A second cam engaging tab 106 is adjacent to the opposite end 108 of each needle jack. Additionally, a different selector abutment tab is disposed intermediately between the tabs 104 and 106 for each needle jack, whereby abutment tab 89 of jack 88 is closer to the end 108 than the abutment tab 91 of jack 90. This tab-to-end relationship continues, so that the abutment tab 91 is closer to the end than the abutment tab 93 of the jack 92, which in turn is closer to the end than the abutment tab 95 of jack 94, and so on for abutment tabs 97, 99 and 101, where abutment tab 101 of jack 100 is the furthest abutment tab from the end 108.

FIG. 6 shows a fragmented illustration of the arrangement of the selectors 40 relative to the needle jacks and associated needles 110 mounted in the slots of the cylinder 10 of the knitting machine, where certain parts have been omitted for a simpler presentation thereof. Accordingly, the slots 86 in the cylinder 10 has been omitted in addition to some of the needle jacks and needles 110 for the above-mentioned clearer presentation. As shown, the seven selectors 40 are disposed one above each other so that in this particular arrangement of the needle jacks, a particular selector 40 can only be associated with every seventh abutment tab. For example, the selector 40 at the top of the stack is only associated with abutment tabs 101 of jacks 100, and the selector 40 at the bottom of the stack is associated with abutment tabs 89 of jacks 88.

Figure 7:
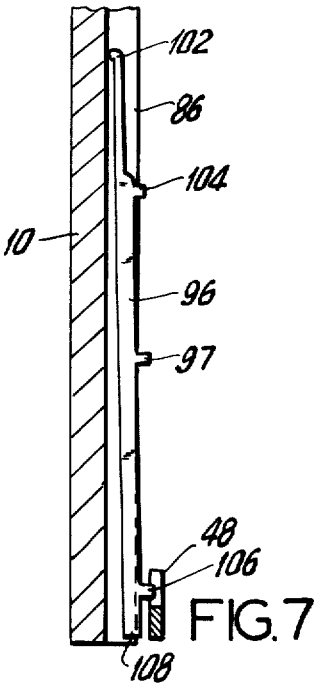
FIG. 7 represents a fragmented selectional view, taken on the line 7—7 of FIG. 6.
Figure 8:
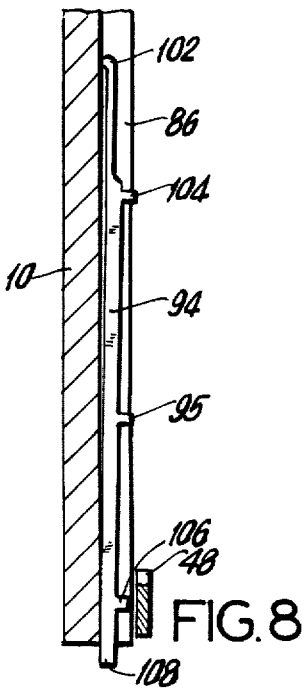
FIG. 8 represents a fragmented selectional view, taken on the line 8—8 of FIG. 6.
Figure 9:
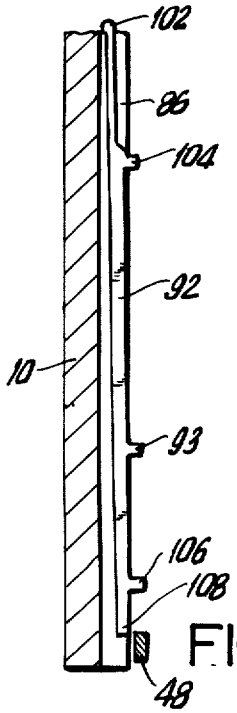
FIG. 9 represents a fragmented selectional view, taken on the line 9—9 of FIG. 6.

The knitting needles 110 are conventional, being disposed into the cylinder slots above the jacks and in a spaced relationship to the jacks, as is well known in the art. Each needle 110 is provided with a cam engaging tab 112, which is similar to the cam engaging tabs 104 and 106 of the needle jack. Before the needles 110 and jacks reach the selectors 40, all the needles and needle jacks are in the same relative position to each other in the cylinder slots. The pivot end 102 is disposed against the bottom of the slot, as best shown in FIG. 7, with the opposite end 108 being disposed out of the slot and below the cylinder 10, as shown in FIGS. 6 and 8. Additionally, the end 108 is raised from the bottom of the slot so that the selector abutment tab is positioned out of the slot, as shown in FIGS. 7 and 9. As the needle jack passes by its associated selector 40, the selector 40 will be in either one of two positions. If the associated point on the tape loop for that particular feed station has not been punched, the associated solenoid 34 has therefore not been activated and the selector connected thereto will be in its normal "out" position away from the cylinder 10. However, if the associated point on the tape loop 24 has been punched, the light from the source 28 will activate the associated photo cell which in turn will activate the associated solenoid 34 to cause the core 36 to move out of the solenoid 34 and cause the rod 38 to rotate the end 41 of the selector 40 in a direction towards the needle jacks, to thereby position the end 41 adjacent to the cylinder 10 in an abutment or "in" position.

Accordingly, as a jack passes by its associated selector which is in the "in" position, the end 41 of the selector 40 will abut against its associated abutment tab of the jack which is moving by the selector. The end 41 will force the abutment tab into the slot 86 as the jack pivots about its end 102. The jack will assume a position similar to jack 94, shown in FIG. 8, where the abutment tab 95 is now positioned in the groove 86.

After the jacks pass by the stack of selectors 40 they will pass by the cam 48. As best shown in FIGS. 7, 8 and 9, the cam 48 is spaced from the outer surface of the cylinder 10. Accordingly, those jacks that have been acted upon by their associated selectors 40 will be positioned within the slots 86 so that the engaging tabs 106 cannot come in contact with the cam 48. However, those jacks which have not been acted upon by their associated selectors 40 will be positioned so that the engaging tabs 106 do come in contact with the inclined surface of the cam 48.

As shown in FIGS. 6 and 7, jack 96 which has not been acted upon by its associated selector 40, has its engaging tab 106 contacting the inclined surface of the cam 48, so that as the jack 96 is passing by the cam 48, the inclined surface of the cam 48 is causing the tab 106 to rise up thereon, which in turn has raised the jack 96 into abutment with its associated needle 110.

The jack 96 will continue to rise, causing its associated needle 110 to project above the cylinder 10 to perform its conventional function of knitting. But, the needle 110 associated with needle jack 94 shown in FIGS. 6 and 8, will remain in its usual position within the slot 86 of the cylinder 10, and will not perform any knitting function. The raised needles 110 and their associated jacks will remain in this upper position once they have passed the cam 48, as shown by way of example of jack 92 in FIGS. 6 and 9.

The needle jacks and the needles 110 after performing their conventional knitting functions, are returned to their normal positions in the slots 86 of the cylinder 10 by conventional cams 50 and 52, which are well-known in the art. Conventional cam 50 first acts on the engaging tabs 104 of the raised jacks to force these jacks back down to their normal position with their ends 108 extending beyond the bottom of the cylinder 10. Additionally, the cam 50 next acts upon the tabs 112 of the needles 110 to lower the raised needles to their normal position within the slots 86 of the cylinder 10 in a spaced position from their associated needle jacks.

With all the needle jacks now in their lower position, the conventional cam 52 abuts against the ends 108 of all the jacks that were acted upon by their associated selectors 40, to force these jacks to pivot about their ends 102 in order to raise the ends 108 from the bottom of the slots 86 into their normal position with the selector abutment tab positioned out of the slot. Therefore, the needle jacks and their associated needles are now in their normal position and ready to proceed to the next feed station where the above procedure is again repeated.

It is noted from the above arrangement, that those needles associated with punched out points on the tape 24 do not perform any knitting functions at the particular feed station. However, if desired, the coaction between the solenoids 34 and selectors 40 can be changed so that only those needles associated with the punched out points on the tape 24 perform the knitting functions.

For example, by positioning the end 41 of each selector 40 next to the cylinder 10 for engagement with each associated abutment tab as it moves by, and positioning the spring 44 on the opposite side of the end 43 to hold the end 41 in this position, every needle jack passing by its associated selector will be forced down into the slots 86 so that its tab 106 will not be engaged by the cam 48, whereby its associated needle will not be raised to its knitting position and thereby not function.

The next step would be to modify each solenoid 34 so that the core 36 retracts into the solenoid 34 when the solenoid is activated. The last step would be to connect a cord or wire between the end of the core 36 and the end 41 of the selector 40 so that when each solenoid is activated, its core will pull into the solenoid and cause the cord or wire attached thereto to pull the end 41 of the associated selector 40 away from the cylinder 10, so that the end 41 cannot engage nor act upon the abutment tab of its associated needle jack. Thus, those needle jacks which are not acted upon by their selectors, will be raised by the cam 48 to thereby position its associated needle for knitting. Thus it is seen, that the present invention can be modified to permit the punched out points of the tape 24 to be directly associated with the needles performing the knitting function.

Figure 10:
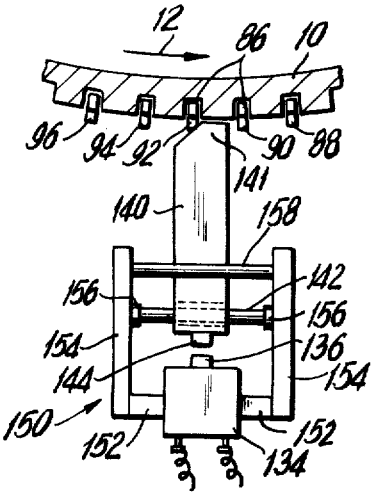
FIG. 10 represents a fragmented top plan view with parts in section, showing a modified selector mounted relative to the cylinder of the kintting machine.
Figure 11:
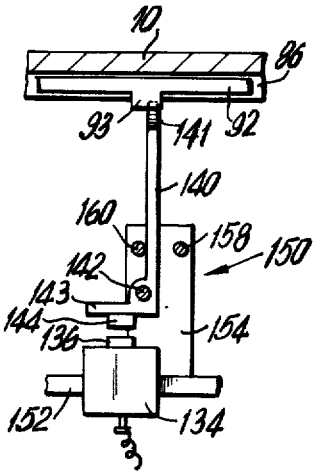
FIG. 11 represents a fragmented side elevational view with parts in section, showing the modified selector of FIG. 10 in an operative position.
Figure 12:
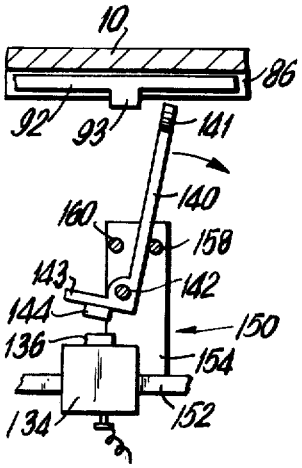
FIG. 12 represents a fragmented side elevational view with parts in section, showing the modified selector of FIG. 10 in a non-operative position.

In addition to the above-mentioned modification, FIGS. 10, 11 and 12 illustrate a modified selector 140 mounted at a feed station adjacent to the cylinder 10. The selector 40 is L-shaped, having a shorter leg portion 143, and a tapered or inclined tip portion 141 at the end of the longer leg. The selector 140 is adapted to be rotated by means of a pin 142 which is secured thereto. A permanent magnet 144 is secured on the shorter leg portion 143.

A support member 150 positions the selector 140 relative to the cylinder 10. The support member 150 includes vertically extending bar-like members 152, and a pair of horizontal arm members 154 connected to the members 152 and disposed on each side of the selector 140. The ends of the pin 142 are disposed in sockets 156 provided on each of the arm members 154, so that the selector 140 is free to pivot or rotate relative to the support member 150. A pair of stop pins 158 and 160 which extend from one arm member 156 to the other arm member, limit the rotation of the selector 140.

A conventional electro-magnet 134 is secured to the bar-like members 142, being disposed between the arm members 154. A magnetizable portion 136 of the electro-magnet 134 is disposed adjacent to the the selector magnet 144, being slightly spaced therefrom. The magnetizable portion 136, when magnetized, has a magnetic pole which is the same as the magnetic pole of the selector permanent magnet 144 facing it, both being north or south poles, so that the magnetizable portion 136 repels the selector magnet 136 away from it in a conventional manner, well known in the art of magnetism.

Similar to the above-mentioned structure, there are preferably seven selectors 140 at each feed station, each selector having its own associated electro-magnet 134, which replaces the above-mentioned solenoids 34. The operation of the other elements in the knitting machine remains the same. However, in this modified embodiment, the needles associated with the punched out points on the tape 24 perform the knitting functions, for the reasons set forth below. But, as mentioned above, the position of the selectors 140 can be changed if desired so that the needles associated with the punched out portions on the tape 24 do not perform any knitting functions, such being considered an obvious modification thereof.

When the electro-magnet 134 is not energized, the selector 140 is dosposed in the position shown in FIG. 11, with the end portion 141 being disposed close to the cylinder 10 for abutment with the tab 93 on the jack 92, and with the selector magnet 144 being magnetically attracted to the non-magnetized metal portion 136 of the electro-magnet 134. Accordingly, in this position, the abutment tab 93 will come in contact with the inclined surface of the selector tip 141, causing the jack 92 as it passes by to be pushed inwardly into the groove 86, in a similar manner as mentioned above, so that the needle associated with the jack 92 will perform no knitting function, for the reasons set forth above.

However, if the electro-magnet 134 is activated by the light from the light source 28 passing through an opening in the tape loop 24, the magnetized portion 136 will repel the selector magnet 144 for the reasons mentioned above, so that the selector 140 rotates with the pin 142 in a clockwise direction as shown in FIG. 12, until it is stopped by the stop pin 158. In this position, the selector tip 141 is disposed away from and cannot contact the abutment tab 93 so as to be non-operative. Accordingly, as mentioned above, the cam 48 can now engage the jack 92 and position the needle associated therewith for its knitting function. When the electro-magnet 134 is deactivated, the selector magnet 144 will again be attracted to the metal portion 136 of the electro-magnet 134, so that the selector 140 will rotate in a counter-clockwise direction until it is stopped by the other stop pin 160, and again is in the operative position shown in FIG. 11.

Figure 13:
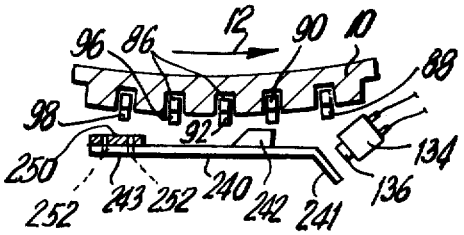
FIG. 13 represents a fragmented top plan view with parts in section, showing another modified selector mounted relative to the cylinder of the knitting machine, the selector being shown in a non-operative position.
Figure 14:
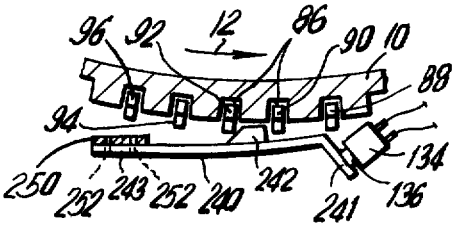
FIG. 14 represents a fragmented top plan view with parts in section, showing the modified selector of FIG. 13 in an operative position.
Figure 15:
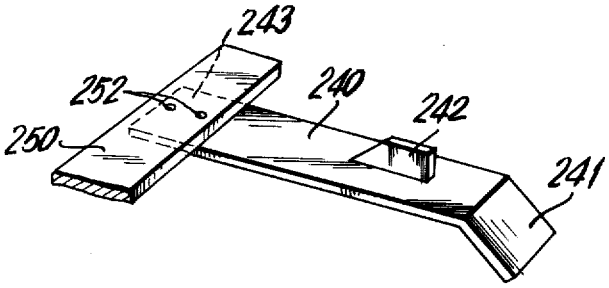
FIG. 15 represents a fragmented prospective view showing the modified selector of FIGS. 13 and 14.

FIGS. 13, 14 and 15 illustrate a still further modified selector 240, which is mounted at a feed station adjacent to the cylinder 10. The selector 240 coacts with the above-mentioned electro-magnet 134. As will be shown below, the selector 240 functions in a similar manner as the above-mentioned selector 40, where the needles associated with the punched out points on the tape 24 do not perform any knitting function. However, as mentioned above, the position of the selector 240 can be changed if desired so that the needles associated with the punched out portions on the tape 24 do perform the knitting functions, here again such modification being considered obvious to one skilled in the art in view of the structure herein disclosed.

The selector 240 is fabricated from a thin magnetically attractable metal, which is resilient and flexible to provide the selector with spring-like characteristics. A free end portion 241 of the selector 240 is bent or offset to provide an upwardly and outwardly extending tip portion. The opposite end 243 is secured by conventional means such as rivets 252 or the like to a bar-like support member 250 which is maintained by conventional means in a stationary position relative to the cylinder 10. A projection or tab 242 is provided on the body of the selector 240, as best shown in FIG. 15. The tab 242 faces inwardly towards the cylinder 10, and is provided with an inclined or tapered edge portion, as shown. The magnetizable portion 136 of the electro-magnet 134 is disposed adjacent to the tip portion 241 of the selector 240, but is normally spaced therefrom as shown in FIG. 13.

As in the above-mentioned structures, there are preferably seven selectors 240 at each feed station, each selector being secured one above the other to the support member 250. An electro-magnet 134 is associated with each selector 240, where the operation of these elements and the other elements in the knitting machine are basically the same as mentioned above.

When the electro-magnet 134 is not energized, the selector 240 is disposed in the position shown in FIG. 13, with the end portion 241 being spaced from the electro-magnet 134 so that the selector tab 242 does not come in contact with the needle jacks. Accordingly, in this position, the selector 240 is non-operative.

However, if the electro-magnet 134 is activated by the light from the light source 28 passing through an opening in the tape loop 24, the magnetized portion 136 will attract the metal tip portion 241 of the selector 240. Accordingly, the tip portion 241 will move or bend towards the electro-magnet 134, and will be secured to the magnetized portion 136 as shown in FIG. 14. This movement causes the selector tab 242 to move or rotate inwardly towards the cylinder 10, and into the path of the abutment tabs on the needle jacks. Thus the associated needle jacks, as they pass by the operative positioned selector 240, will be pushed inwardly by the inclined edge of the selector tab 242 into the groove 86 in a similar manner as mentioned above, so that the needles associated with these pushed in needle jacks will form no knitting function for the reasons set forth above. When the electro-magnet 134 is deactivated, the selector 240 will spring back to its original non-operative position shown in FIG. 13.

In the above illustration of the present invention, it is further noted that each section of the tape loop 24 included seven lines for controlling seven selectors respectfully, which in turn acted upon an associated jack of each set of seven different jacks as shown in FIG. 5, so that seven is the common factor of these elements. This factor of seven was used for illustration purposes only, being considered the best number for use with the above-mentioned KIM knitting machine which has a particular revolutions per minute for its cylinder 10, but understandingly eight or other factors may be used as desired.

Accordingly, for knitting machines having a cylinder with a higher revolutions per minute, this factor should be increased to provide more selecting accuracy. For example, at a present cylinder rpm, one selector in a set of ten selectors does not have to be activated as fast as a selector in a set of seven, where a knitting machine using 280 needles, a selector in a set of ten selectors is activated only twenty-eight times per revolution of the cylinder compared to the required forty activations per revolution of a selector in a set of seven selectors. Obviously, if the number of selectors is increased, the number of lines in each section of the tape 24 will also be increased, together with the associated photo electric cells, amplifiers, solenoids, and needle jacks in each set. From the above, it would also be understood that in a knitting machine having a cylinder with a low cylinder rpm, the number of selectors and associated elements can be reduced.

It is further noted, that when the clutch 20 is activated, as mentioned above with respect to control hole 82, the cylinder 10 will continue to rotate while the tape loop 24 has stopped because of the disengagement of drive wheel 16. This permits the knitting machine to continue to function to knit conventional cuffs, borders and the like which do not require any special designs. The above-mentioned pattern drum of the prior art can also be stopped for the same purpose, such stoppage being well-known in the art. After a predetermined time or revolutions of the cylinder, the drive wheel 16 is again engaged, by conventional means well-known in the art, so that the tape loop 24 again continues to move in the counter-clockwise direction of arrow 26, and the above-mentioned selection process is repeated.

Numerous alterations of the structure herein disclosed will suggest themselves to those skilled in the art. However, it is to be understood that the present disclosure relates to a preferred embodiment of the invention which is for purposes of illustration only and not to be construed as limitations of the invention.

What is claimed is:

1. A selection device for knitting machines having a rotating cylinder with slots around its circumference for accommodating a knitting needle and an associated needle jack in each slot, said device comprising selection tape means for controlling a number of jack selectors of at least one feed station, said jack selectors being disposed adjacent to the cylinder, a portion of each of said jack selectors being movable between a first position away from the cylinder for preventing engagement with the needle jacks to define an operative jack position and a second position close to the cylinder for engagement with associated needle jacks to move each of said associated jacks into its slot to define a non-operative jack position, said selection tape means including a tape loop and stationary detecting means coacting with said tape loop for determining said first and second positions of said portion of each of said jack selectors to provide a predetermined knitting pattern, drive means for moving said tape loop in synchronization with the cylinder and relative to said stationary detecting means, cam means for moving each of said needle jacks in said operative jack position along its slot into engagement with its associated knitting needle to move said associated knitting needle into an active position for knitting said knitting pattern, where the needles associated with each of said needle jacks in said non-operative jack position remain in their respective slots and are non-active during said knitting, said tape loop including at least one section longitudinally around said tape loop, said section including adjacent portions extending longitudinally around said tape loop, each of said tape loop portions being associated with one of said jack selectors at said feed station, a plurality of detectable means being disposed in longitudinally adjacent rows extending transversely across width of a said section and intersecting said tape loop portions to provide individual detectable means associated with a particular needle jack and knitting needle, said detecting means controlling said jack selectors by consecutively detecting said individual detectable means transversely across each of said rows, row-by-row, to determine said first and second positions of each of said jack selectors for providing said operative and non-operative jack positions, said stationary detecting means being disposed diagonally with respect to the transversely extending rows of detectable means for controlling said jack selectors.

2. A selection device as claimed in claim 1, wherein said tape loop includes a plurality of sections extending longitudinally around said tape loop in a side-by-side arrangement, each section being associated with a different feed station of a knitting machine.

3. A selection device as claimed in claim 1, including disengagement means for stopping said drive means, said selection tape means being associated with said disengagement means for controlling the stopping of said drive means.

4. A selection device as claimed in claim 1, wherein said detectable means include openings extending through said tape loop, said detecting means including a light source and one photo electric cell for each jack selector, said openings allowing light from said light source to pass therethrough for activating said photo electric cells, whereby each of said photo electric cells when activated affects the movement of said portion of an associated jack selector to provide the predetermined knitting pattern.

5. A selection device as claimed in claim 4, including disengagement means for stopping said drive means, at least one of said openings in said tape loop being associated with said disengagement means for controlling the stopping of said drive means.

6. A selection device as claimed in claim 4, wherein said selection tape means include one solenoid for each jack selector, each solenoid having a movable core connected to an associated one of said photo electric cells, whereby each of said photo electric cells when activated energizes an associated solenoid to operate its core for moving an associated one of said jack selectors.

* * * * *